US006350184B1

(12) United States Patent
Holzapfel

(10) Patent No.: US 6,350,184 B1
(45) Date of Patent: Feb. 26, 2002

(54) POLISHING PAD CONDITIONING DEVICE WITH CUTTING ELEMENTS

(75) Inventor: Paul Holzapfel, Chandler, AZ (US)

(73) Assignee: Speedfam-IPEC Corporation, Chandler, AZ (US)

( * ) Notice: Subject to any disclaimer, the term of this patent is extended or adjusted under 35 U.S.C. 154(b) by 0 days.

(21) Appl. No.: 09/642,954

(22) Filed: Aug. 21, 2000

Related U.S. Application Data

(63) Continuation of application No. 08/984,243, filed on Dec. 3, 1997, which is a continuation-in-part of application No. 08/683,571, filed on Jul. 15, 1996, now Pat. No. 5,842,912.

(51) Int. Cl.[7] ..... B24B 7/00; B24B 9/00

(52) U.S. Cl. ..... 451/72; 451/285; 451/443; 125/3; 125/8

(58) Field of Search ..... 51/295; 125/3, 125/4, 8; 451/56, 63, 72, 159, 163, 174, 285–290, 443, 540

(56) References Cited

U.S. PATENT DOCUMENTS

| | | | | |
|---|---|---|---|---|
| 4,505,720 A | * | 3/1985 | Gabor et al. | |
| 4,899,922 A | | 2/1990 | Slutz et al. | |
| 4,968,326 A | * | 11/1990 | Wiand | |
| 5,033,239 A | | 7/1991 | Phillips | |
| 5,486,131 A | * | 1/1996 | Cesna et al. | 451/56 |
| 5,560,754 A | | 10/1996 | Johnson et al. | |
| 5,567,525 A | | 10/1996 | Kapoor et al. | |
| 5,569,062 A | | 10/1996 | Karlsrud | |

* cited by examiner

*Primary Examiner*—Timothy V. Eley
(74) *Attorney, Agent, or Firm*—Snell & Wilmer, LLP

(57) ABSTRACT

A method and apparatus for polishing and planarizing workpieces such as semiconductor wafers is presented. Conditioning rings, which are used to condition polishing pads used in the planarization or polishing of semiconductor wafers, are shown which utilize brazed diamond technology in association with a coating of a titanium nitride containing composition or a thin film diamond deposition in order to reduce the fracturing and loss of cutting elements bonded to the conditioning ring.

27 Claims, 6 Drawing Sheets

POLISHING PAD CONDITIONING DEVICE WITH CUTTING ELEMENTS

This application is a Continuation of U.S. application Ser. No. 08/984,243 filed Dec. 3, 1997, which is a Continuation-In-Part of U.S. application Ser. No. 08/683,571 filed Jul. 15, 1996, which issued into U.S. Pat. No. 5,842,912 on Dec. 1, 1998.

FIELD OF THE INVENTION

The present invention generally relates to methods and apparatus for polishing or planarizing workpieces such as semiconductor wafers. More particularly, the present invention relates to methods and apparatus for conditioning polishing pads used for the planarization of workpieces. The present invention is also directed to a methods and apparatus for the planarization of workpieces which utilizes diamond brazed conditioning rings having a titanium nitride based coating or a coating comprising a thin film diamond deposition.

BACKGROUND OF THE INVENTION

The production of integrated circuits began with the creation of high-quality semiconductor wafers. During the wafer fabrication process, the wafers may undergo multiple masking, etching and dielectric and conductor deposition processes. Because of the high-precision required in the production of these integrated circuits, an extremely flat surface is generally needed on at least one side of the semiconductor wafer to ensure proper accuracy and performance of the microelectronic structures being created on the wafer surface. As the size of the integrated circuits continues to decrease and the density of the microstuctures per integrated circuit increases, the need for precise wafer surfaces becomes more important. Therefore, between each processing step, it is usually necessary to polish or planarize the surface of the wafer to obtain the flattest surface possible.

For a discussion of chemical mechanical planarization (CMP) processes and apparatus, see, for example, Arai, et al., U.S. Pat. No. 4,805,348, issued February, 1989; Arai, et al., U.S. Pat. No. 5,099,614, issued March, 1992; Karlsrud et al., U.S. Pat. No. 5,329,732, issued July, 1994; Karlsrud, U.S. Pat. No. 5,498,196, issued March, 1996; and Karlsrud et al., U.S. Pat. No. 5,498,199, issued March, 1996.

Such polishing is well known in the art and generally includes attaching one side of the wafer to a flat surface of a wafer carrier or chuck and pressing the other side of the wafer against a flat polishing surface. In general, the polishing surface comprises a horizontal polishing pad that has an exposed abrasive surface of, for example, cerium oxide, aluminum oxide, fumed/precipitated silica or other particulate abrasives. Polishing pads can be formed of various materials, as is known in the art, and which are available commercially. Typically, the polishing pad may be a blown polyurethane, such as the IC and GS series of polishing pads available from Rodel Products Corporation in Scottsdale, Arizona. The hardness and density of the polishing pad depends on the material that is to be polished.

During the polishing or planarization process, the workpiece (e.g. wafer) is typically pressed against the polishing pad surface while the pad rotates about its vertical axis. In addition, to improve the polishing effectiveness, the wafer may also be rotated about its vertical axis and oscillated back and forth over the surface of the polishing pad. It is well known that polishing pads tend to wear unevenly during the polishing operation, causing surface irregularities to develop on the pad. To ensure consistent and accurate planarization and polishing of all workpieces, these irregularities should either be removed or accounted for.

One method of removing the surface irregularities which develop in the polishing pad is to condition or dress the pad with some sort of roughing or cutting means. Generally this truing or dressing of the polishing pad can occur either while the wafers are being polished (in-situ conditioning), or between polishing steps (ex-situ conditioning). An example of ex-situ conditioning is disclosed in Cesna, et al., U.S. Pat. No. 5,486,131, issued on Jan. 23, 1996, and entitled Device for Conditioning Polishing Pads. An example of in-situ conditioning is disclosed in Karlsrud, U.S. patent application Ser. No. 08/487,530, filed on Jul. 3, 1995, and entitled Polishing Pad Conditioning. Both the Cesna, et al. patent and the Karlsrud application are herein incorporated by reference.

Generally, in the semiconductor wafer polishing and planarization context small roughing or cutting elements, such as diamond particles, are used to condition the polishing pads. As shown in both the Cesna, et al, patent and the Karlsrud application, both in-situ and ex-situ conditioning apparatus utilize circular ring conditioners which have these cutting elements secured to a bottom flange of the ring. Generally, these cutting elements are secured to the bottom surface of the flange of the carrier ring by an electroplating process or brazing process. Electroplating produces a simple mechanical entrapment of the cutting elements on the carrier ring by depositing metal, for example in a layer-by-layer fashion around the cutting elements until they are entrapped. However, one problem with the electroplating process is that the electroplating bond holding the cutting elements to the ring surface is relatively weak and the cutting elements occasionally become dislodged from the conditioning ring and embedded in the polishing pad. Further, because the electroplating bond is susceptible to shearing forces, a substantial amount of bonding material is needed to hold the cutting elements in place. As a result, the bonding material actually covers most, if not all, of the many cutting elements, thereby compromising the conditioning capacity of the conditioning ring. Thus, the previously mentioned brazing process is preferred. A detailed discussion of the brazing process is discussed herein as well as in Holzapfel, et al., U.S. patent application Ser. No. 08/683,571, filed Jul. 15, 1996, which is herein incorporated by reference.

The cutting elements which are secured to the bottom surface of the flange of carrier rings may comprise diamonds, polycrystalline chips/slivers, silicon carbide particles, and the like. However, regardless of whether the conditioning rings are braze plated or electroplated in order to retain the cutting elements, such as diamonds, these processes are not ideal in that they exhibit a very short lifetime which results in diamond loss, diamond fracture, or plating wear. As previously indicated, these lost or fractured diamonds can cause severe scratches in the wafers that are being polished. Wafers that are scratched are considered to be scrap and this can result in increased costs to the consumer. Further, the short lifetime of the conditioning rings due to plating wear is significant in that the conditioning rings are typically the most expensive consumable component part on the CMP apparatus.

Although the brazing of the cutting elements to secure them to the carrier ring is preferable over the electroplating process, there are still some problems associated with the brazing process. The problems associated with the unreliability of the bond created using brazed diamond technology in various applications has been addressed in the prior art.

For example, in Kapoor at al., U.S. Pat. No. 5,567,525, the reliability of a braze joint formed between a diamond film and a tungsten carbide object is increased by covering the diamond film with a braze comprising vanadium. Further, a method for utilizing high temperature and high pressure to form a polycrystalline composite compact having reduced abrasive layer stresses is disclosed in U.S. Pat. No. 5,560,754 issued to Johnson et al. Also, U.S. Pat. No. 4,899,922, issued to Slutz et al., describes a brazed implement having a thermally stable polycrystalline diamond with shear strengths exceeding about 50 kpsi even while furnace cycling the brazed implements. This is achieved by brazing the compact to another compact or to a cemented carbide support using a brazing alloy containing an effective amount of chromium and having a liquidus above about 700 degrees C. Still, each of these methods for creating a more reliable brazed bond requires substantial mechanical and/or chemical manipulation including a temperature application. Further, none of these prior art patents suggests the use of their respective methods in a semiconductor processing capacity, particularly in the conditioning of conditioning rings used in that application process.

Accordingly, there is a need for an improved method and apparatus for conditioning polishing pads used in the polishing or planarization of semiconductor wafers. More particularly, there is a need for a simple and efficient method and apparatus for conditioning the rings which are used for conditioning the polishing pads so that there is a decrease in diamond loss, diamond fracture and plating wear of the conditioning rings thereby resulting in a longer life for the conditioning rings and a decrease in cost to the end consumer utilizing semiconductor chips.

SUMMARY OF THE INVENTION

It is a principal object of the present invention to provide an improved method and apparatus for polishing or planarizing workpieces such as semiconductor wafers.

It is another object of the present invention to produce improved diamond brazed conditioning rings used for conditioning polishing pads in the planarization of workpieces.

It is still another object of the present invention to provide a method and apparatus for polishing workpieces which includes the coating of a conditioning ring used to condition the polishing pad such that fractures and losses of the cutting elements contained on the conditioning ring are significantly reduced.

It is yet another object of the present invention to provide an improved method and apparatus for polishing workpieces which results in less scrap, namely fewer scratched semiconductor wafers.

It is still a further object of the present invention to provide a method and apparatus for polishing workpieces which extends the lifetime of the conditioning rings used in apparatus which perform chemical mechanical planarization processes, thereby decreasing costs associated with polishing and planarizing workpieces.

In brief, the present invention provides methods and apparatus for conditioning polishing pad devices which overcome many of the shortcomings of the prior art. In accordance with one aspect of the present invention, a polishing pad conditioning device for conditioning a polishing pad by contact with the pad is configured with cutting elements, such as diamonds, braze bonded to its bottom surface, and a titanium nitride based coating or a thin film diamond deposition placed over the braze bonded surface. The conditioning device also suitably includes a means for engaging the conditioning means with the polishing pad and for rotating the conditioning means on, and oscillating the conditioning means over, the top surface of the polishing pad.

In accordance with a further aspect of the present invention, the engaging rotating and oscillating means comprises an operating arm adapted for moving the conditioning device into, and out of, operative engagement with the top surface of the pad, and for oscillating the conditioning device radially over the top surface of the pad. The conditioning device comprises a carrier element configured in the shape of a ring, and having cutting elements attached to the bottom surface of the carrier element in a circular ring configuration. Further, a coating of either a composition containing titanium nitride or a thin film diamond deposition is applied over the cutting elements.

In accordance with another aspect of the present invention, the carrier element may include a flange which extends about the periphery of the ring, with the cutting elements being attached to the flange.

In accordance with yet a further aspect of the present invention, the flange includes cut out portions to permit materials to escape from the interior of the carrier ring. In accordance with this aspect of the invention, the cutting elements are distributed substantially uniformly along the flange and the elements are braze bonded to the flange with a brazed metal alloy. Preferably, the brazed metal alloy will only cover about 25% to 75%, and preferably about 40-60%, and most preferably about 50% of the height of the cutting elements. For example, for cutting elements (e.g. diamond particles) having an average height (i.e., diameter) in the range of 50 to 200 micrometers and most preferably about 150 micrometers, the brazed metal alloy should preferably cover each cutting element up to about 50% of its height, or up to about 75 micrometers. Particle sizes in the range of 50 to 200 U.S. mesh, and most preferably about 100 to 120 U.S. mesh are particularly well adapted to the present invention.

In accordance with a further aspect of the present invention, covering less than 25% to 40% of the height of a cutting element with braze may result in an insufficiently secure bond, such that the cutting elements may break away from the braze, thereby liberating the cutting element and perhaps damaging the workpieces. On the other hand, covering the cutting elements with braze in excess of 60% to 80% of the height of the cutting element may impede the ability of the cutting elements to properly dress or condition a pad. Thus, the present inventor has determined that an optimal range involves covering the cutting elements in braze up to about 50% of the height of the cutting elements and then coating the brazed cutting elements with a composition having a titanium nitride base or a thin film diamond deposition.

In accordance with yet a further aspect of the present invention, the conditioning device may be configured to condition the polishing pad at the same time workpieces are being polished. In accordance with this aspect of the invention, the conditioning device preferably is configured to mount to a movable carrier element, which holds the workpieces during polishing.

In accordance with a further aspect of the present invention, the conditioning device is ring figured to mount around the outer perimeter of the workpiece carrier element, wherein the cutting elements are securely attached to the bottom surface of the ring in a circular configuration via brazing of the cutting elements and a titanium nitride coating or a thin film diamond deposition is deposited over the brazed cutting elements.

In accordance with yet a further aspect of the present invention, the cutting elements may be attached to a flange which extends about the periphery of the ring. In addition, the flange preferably may include cut out portions to permit materials to escape from the interior of the ring.

In accordance with yet another aspect of the present invention, the cutting elements used may comprise different materials, such as, for example, diamond particles, polycrystalline chips/slivers, cubic boron nitrite particles, silicon carbide particles and the like. The coating element may comprise SUPERNEXUS, which is a tradename for a titanium nitride product, or a thin film diamond deposition. SUPERNEXUS is produced by GSEM, Inc. located in Beaverton, Oregon and comprises part titanium nitride and part zirconium nitride. Alternatively, the coating element may comprise a thin film diamond coating which consists of man-made diamond components, the bulk of which are comprised of carbon with a minimum of hydrogen. These diamond particles are made synthetically by heating carbon and a metal catalyst in an electric furnace at about 3000 degrees F. under high pressure.

Brief Description of the Drawings

A more complete understanding of the present invention may be derived by referring to the detailed description and claims when considered in connection with the Figures, where like reference numbers refer to similar elements throughout the Figures, and:

Detailed Description of the Preferred Embodiments

The subject invention relates to an improved apparatus for conditioning workpiece polishing pads, and an improved method for securing cutting elements to the apparatus so that the cutting elements do not dislodge from the apparatus and damage the workpieces being polished. While this invention may be used to condition a large variety of polishing pads which may be used to polish a variety of different types of workpieces, the preferred exemplary embodiments discussed herein will relate to polishing pad conditioning apparatuses used to condition semiconductor wafer polishing pads. It will be understood, however, that the invention is not limited to any particular workpiece polishing pad conditioning environment.

Figure 1:
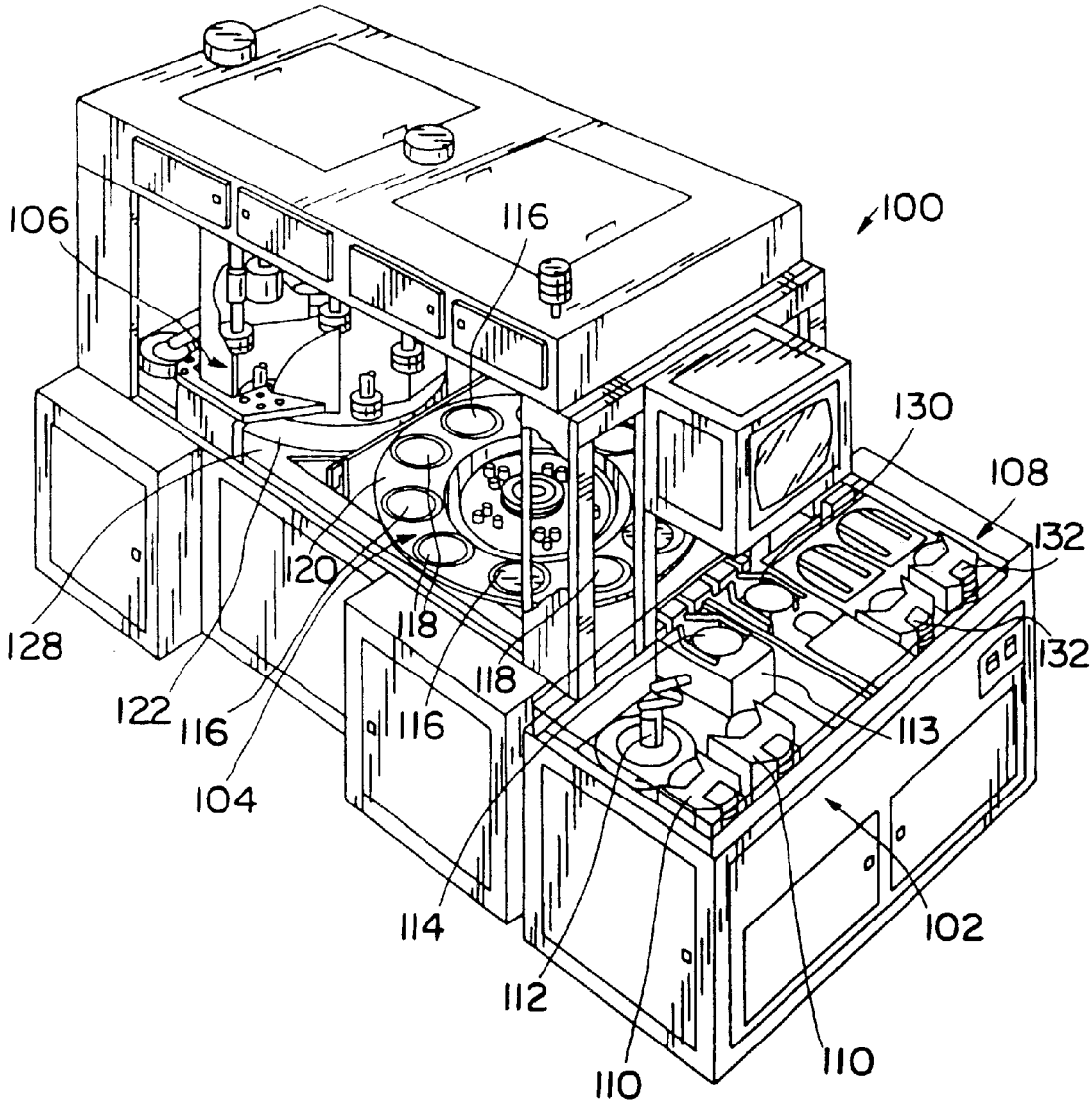
(PRIOR ART) FIG.1
FIG. 1 a perspective schematic view of a semiconductor wafer polishing and planarization machine currently known in the art.
Figure 2:
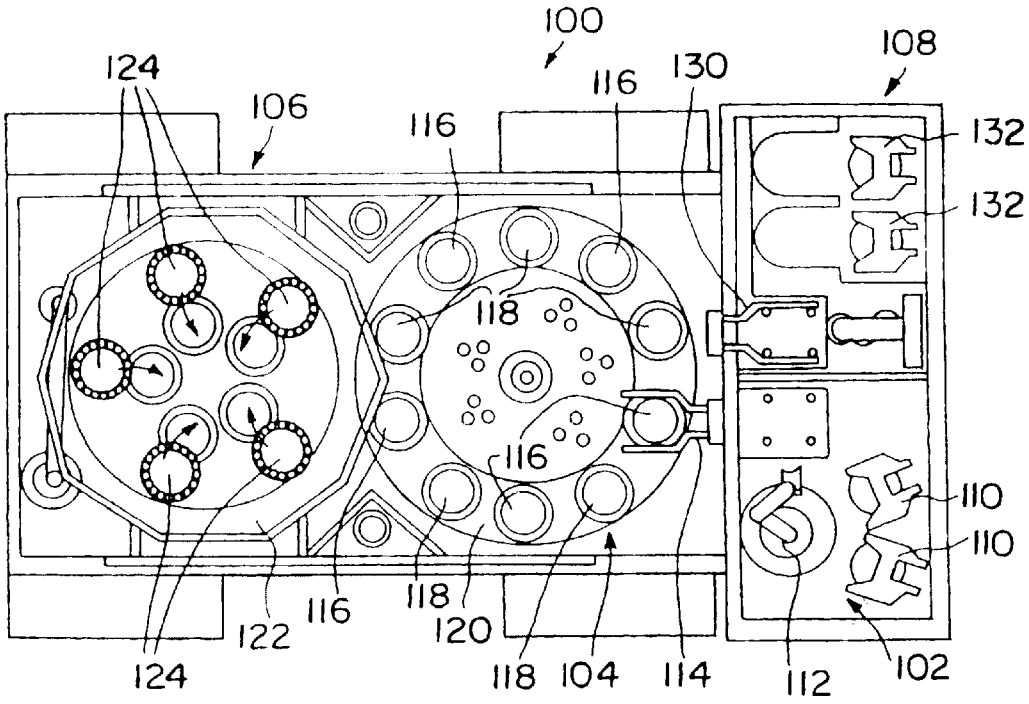
FIGS. 2 and 3, are top cross-sectional views of the wafer cleaning machine shown in FIG. 1 illustrating different parts of the machine at different times in the polishing process.
Figure 3:
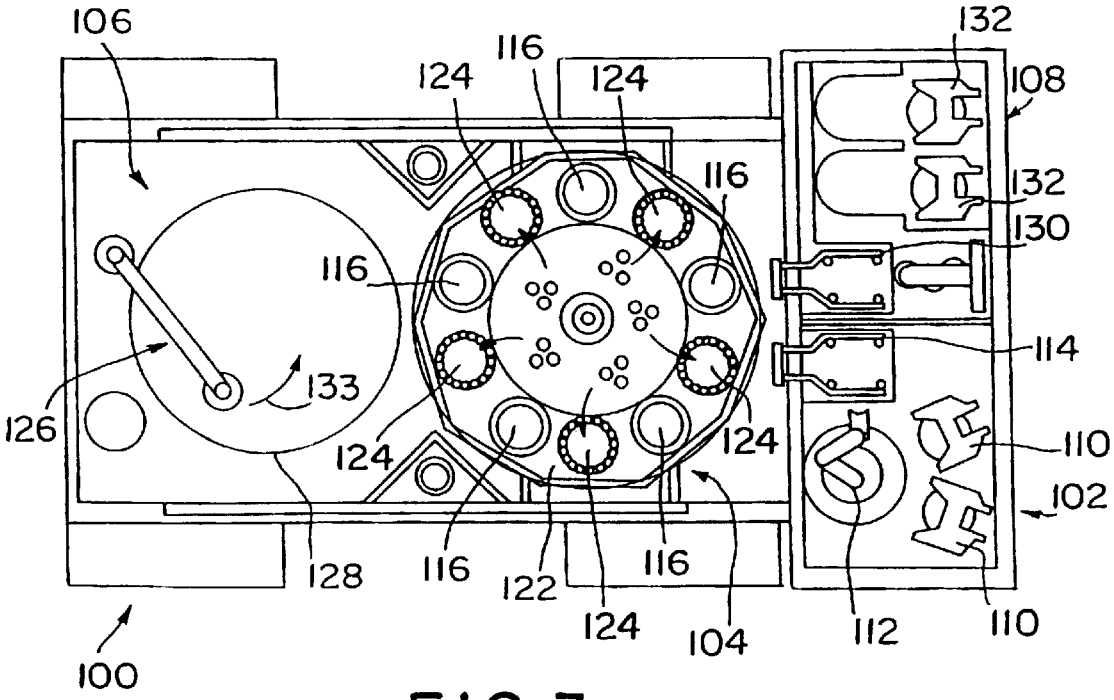

Referring now to FIGS. 1–3, a wafer polishing apparatus 100 is shown embodying the present invention. Wafer polishing apparatus 100 suitably comprises a comprehensive wafer polishing machine which accepts wafers from a previous processing step, polishes and rinses the wafers, and reloads the wafers back into wafer cassettes for subsequent processing. Discussing now the polishing apparatus 100 in more detail, apparatus 100 comprises an unload station 102, a wafer transition station 104, a polishing station 106, and a wafer rinse and load station 108.

In accordance with a preferred embodiment of the invention, cassettes 110, each holding a plurality of wafers, are loaded into the machine at unload station 102. Next, a robotic wafer carrier arm 112 removes the wafers from cassettes 110 and places them, one at a time, on a first wafer transfer arm 114. Wafer transfer arm 114 then lifts and moves the wafer into wafer transition section 104. That is, transfer arm 114 suitably places an individual wafer on one of a plurality of wafer pick-up stations 116 which reside on a rotatable table 120 within wafer transition section 104. Rotatable table 120 also suitably includes a plurality of wafer drop-off stations 118 which alternate with pick-up stations 116. After a wafer is deposited on one of the plurality of pick-up stations 116, table 120 will rotate so that a new station 116 aligns with transfer arm 114. Transfer arm 114 then places the next wafer on the new empty pick-up station 116. This process continues until all pick-up stations 116 are filled with wafers. In the preferred embodiment of the invention, table 120 will include five pick-up stations 116 and five drop-off stations 118.

Next, a wafer carrier apparatus 122, comprising individual wafer carrier elements 124, suitably aligns itself over table 120 so that respective carrier elements 124 are positioned directly above the wafers which reside in respective pick-up stations 116. The carrier apparatus 122 then drops down and picks up the wafers from their respective stations and moves the wafers laterally such that the wafers are positioned above polishing station 106. Once above polishing station 106, carrier apparatus 122 suitably lowers the wafers, which are held by individual elements 124, into operative engagement with a polishing pad 126 which sits atop a lap wheel 128. During operation, lap wheel 128 causes polishing pad 126 to rotate about its vertical axis. At the same time, individual carrier elements 124 spin the wafers about their respective vertical axis and oscillate the wafers back and forth across pad 126 (substantially along arrow 133) as they press against the polishing pad. In this manner, the surface of the wafer will be polished or planarized.

After an appropriate period of time, the wafers are removed from polishing pad 126, and carrier apparatus 122 transports the wafers back to transition station 104. Carrier apparatus 122 then lowers individual carrier elements 124 and deposits the wafers onto drop-off stations 118. The wafers are then removed from drop-off stations 118 by a second transfer arm 130. Transfer arm 130 suitably lifts each wafer out of transition station 104 and transfers them into wafer rinse and load station 108. In the load station 108, transfer arm 130 holds the wafers while they are rinsed.

After a thorough rinsing, the wafers are reloaded into cassettes 132, which then transport the wafers to subsequent stations for further processing or packaging.

During this polishing and planarization process, the polishing pad will wear and thus become less effective. Therefore, it is important to buff or condition polishing pad 126 to remove any surface irregularities that may develop during polishing. Generally, there are two ways to condition the polishing pad; in-situ and ex-situ conditioning. In-situ conditioning takes place during the wafer polishing process, while ex-situ conditioning occurs in between polishing steps.

Figure 4:
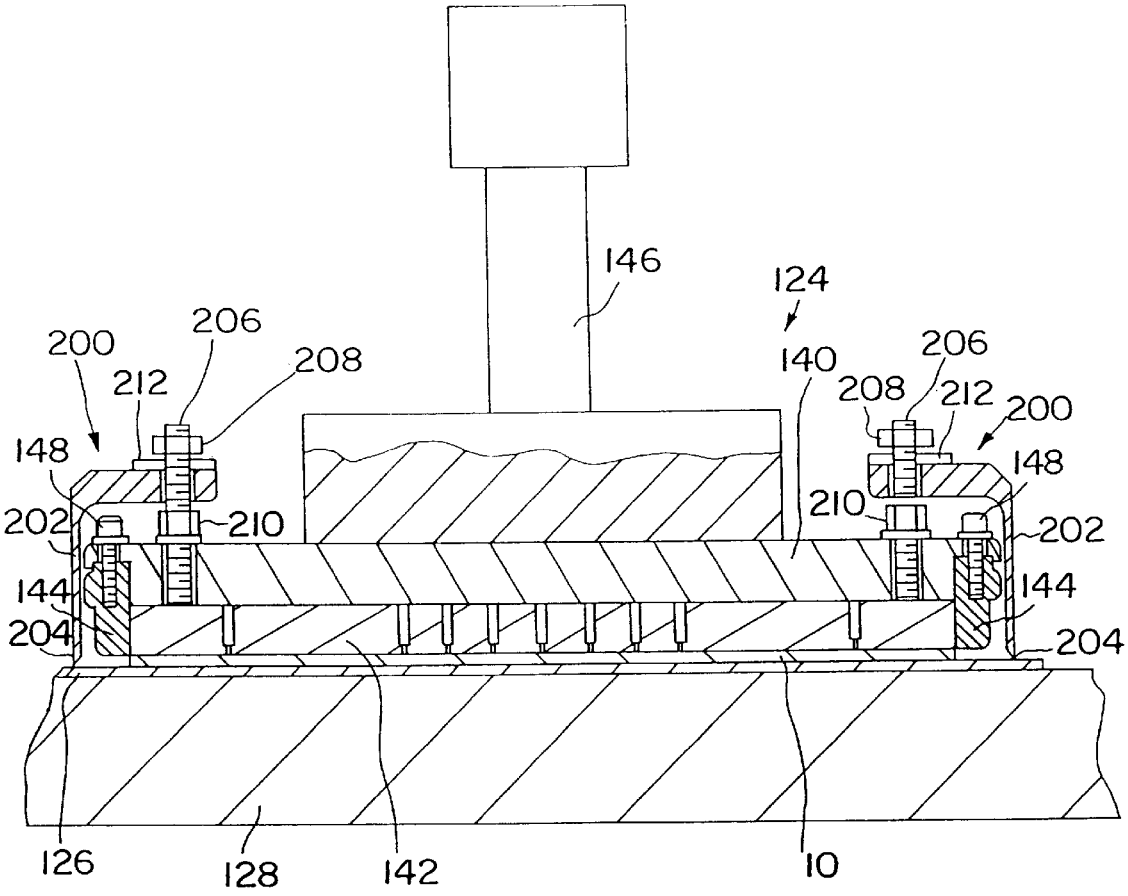
FIG. 4 is a side cross-sectional view of a semiconductor wafer carrier element with an in-situ polishing and conditioning ring connected thereto.

Referring now to FIGS. 2–4, in-situ conditioning will first be discussed. In accordance with a preferred embodiment of the present invention, in-situ conditioning generally occurs by connecting an in-situ conditioning element 200 to each individual carrier element 124. Therefore, as carrier elements 124 rotate and move the wafers over the polishing pad, conditioning elements 200 will also contact the polishing pad, thus conditioning the pad while the wafers are being polished.

Referring now to FIG. 4, the configuration of conditioning element 200 and carrier element 124 will now be discussed. As previously mentioned, carrier element 124 holds and presses the wafers against the polishing pad during the polishing operation. As is well known in the art, carrier element 124 may comprise a number of different embodiments. However, for purposes of discussing the present invention, carrier element 124 will be discussed in accordance with the embodiment shown in FIG. 4.

In accordance with a preferred embodiment of the present invention, carrier element 124 preferably comprises a pressure plate 140, a protective layer 142, a retaining ring 144, and a rotation drive shaft 146. Pressure plate 140 applies an equally distributed downward pressure against the backside of a wafer 10 as it is pressed against polishing pad 126. Protective layer 142 will preferably reside between pressure plate 140 and wafer 10 to protect the wafer during the polishing process. Protective layer 142 may be any type of semi-rigid material that will not damage the wafer as pressure is applied; for example, a urethane-type material. Wafer 10 may be held against protective layer 142 by any convenient mechanism, such as, for example, by vacuum or by wet surface tension. Circular retaining ring 144 preferably is connected around the periphery of protective layer 142 and prevents wafer 10 from slipping laterally from beneath the protective layer as the wafer is polished. Retaining ring 144 is generally connected to pressure plate 140 by bolts 148.

Figure 6:
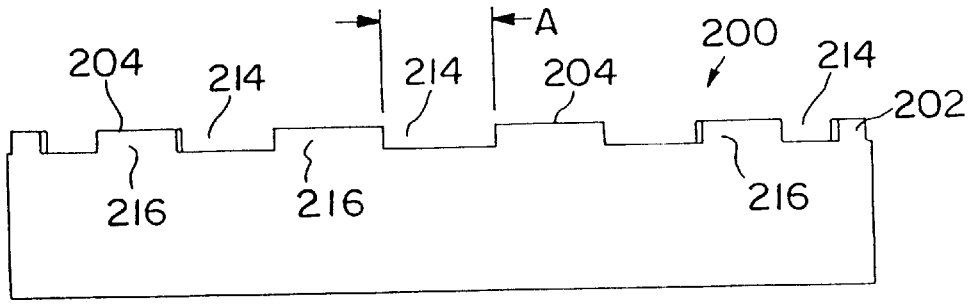
FIG. 6 inside view of the in-situ conditioning ring shown in FIGS. 4 and 5.

Also connected to pressure plate 140 is conditioning element 200 which, in accordance with a preferred embodiment of the invention, is a ring formed of a rigid material, such as metal. As shown in FIGS. 4 and 6, conditioning element 200 preferably includes a downwardly extending flange 202 which terminates in a substantially flat bottom surface 204 having cutting elements 205 attached thereto. Further, a coating 420 (FIGS. 10 and 11) is deposited over the cutting elements 205 to extend the lifetime of the conditioning ring and to reduce or eliminate the loss or fracturing of the cutting elements 205. The coating 420 preferably comprises a titanium nitride base or, alternatively, may comprise thin film diamond. The flange 202 is of sufficient length so that bottom surface 204 with attached cutting elements 205 will contact the polishing pad during processing. Further, conditioning element 200 preferably will be loosely connected to pressure plate 140 by bolts 206. This relatively loose connection between pressure plate 140 and conditioning element 200 allows limited vertical movement but restricts lateral movement of conditioning element 200. The vertical movement of the conditioning element 200, which occurs between nuts 208 and 210 (FIG. 4), is permitted so that the cutting elements 205 contact pad 126 by virtue of the weight of conditioning element 200, rather than by pressure applied by carrier element 124. If needed, additional weighted rings 212 may be added to conditioning element 200 to increase the weight of the ring and thus the conditioning pressure on the pad.

Figure 5:
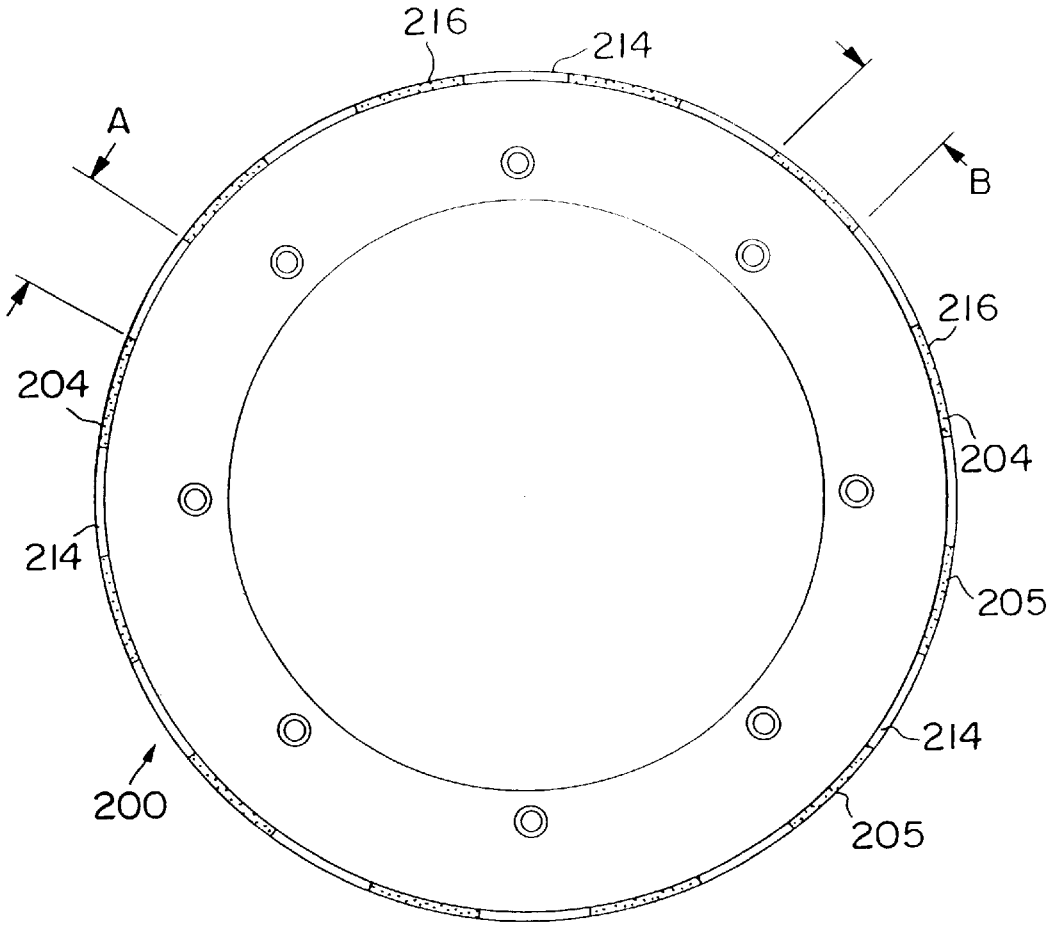
FIG. 5 is a top view of the in-situ polishing pad conditioning ring shown in FIG. 4.

In accordance with a further aspect of the preferred embodiment of the present invention, flange 202 may include cut out portions 214 which permit sworf and fluids to escape from the interior of conditioning element 200. Accordingly, as shown in FIGS. 5 and 6 as dimension "A", cut out portions 214 may be in the range about 0.75 to 1.25 inches and more preferably in the range of about 0.875 to 1.125 inches. The remaining portions of flange 202, which have cutting elements 205 attached thereto, are shown in FIGS. 5 and 6 as elements 216. The size of the remaining flange portions 216 are illustrated in FIG. 5 as dimension "B" and are in the range of about 0.75 to 1.25 inches and more preferably in the range of about 0.875 to 1.125 inches.

In accordance with yet another aspect of the present invention, cutting elements 205 may be any hard cutting material useful for conditioning pads, such as, for example, diamond particles, polycrystalline chips/slivers, cubic boron nitrite particles, silicon carbide particles, and the like. Further, cutting elements 205 may be secured to bottom surface 204 of flange 202 by a brazed bonding process which creates an extremely secure bond. This bonding process will be discussed in more detail below.

As previously indicated, the composition used to coat the braze bonded cutting elements 205 (FIGS. 10 and 11) is preferably comprised of a titanium nitride base or of thin film diamond. Titanium nitride has the following properties:

Melting Point 2927 degrees C.

Specific Heat 8.86 cal/mole at 25 degrees C.

Electrical Resistivity 21.7 micro-ohm-cm

These properties of titanium nitride allow the coating composition to protect the cutting elements 205, particularly diamond particles, from fracturing and flaking off from the flange 202 of the conditioning element 200. More specifically, the coating composition fills in minor fracture lines in the diamonds which reduces or eliminates the possibility of the diamonds fracturing off of the flange 202 during the conditioning cycle. The coating 420 also protects softer and more susceptible plating, such as electroplating, which results in reducing the wear of the plating. The coating also forms a much stronger bond between the plating and the diamonds, or cutting elements 205. The reduction or elimination of the fracturing of cutting elements during the conditioning cycle results in fewer scratched semiconductor wafers which must be scrapped. A thin film diamond deposition over the cutting elements 205 can also produce these improvements in the conditioning process.

During operation of apparatus 100, wafer 10 held by carrier element 124 is brought into contact with polishing pad 126 which is secured to lap wheel 128. Preferably, to maximize polishing, an abrasive slurry is introduced between polishing pad 126 and wafer 10. Various types of abrasive slurries can be used, as is known in the art. As wafer 10 contacts pad 126, both lap wheel 128 and carrier element 124 rotate, thus facilitating the polishing and planarization of the wafer. In addition, as carrier element 124 lowers wafer 10 onto the pad, conditioning element 200, which is connected to carrier element 124, will be lowered into contact with the pad. As lap wheel 128 and carrier element 124 rotate, cutting elements 205 will rough-up and, thus, condition polishing pad 126 at the same time the wafers are being polished.

In accordance with an alternate embodiment of the present invention, the ex-situ conditioning device of apparatus 100 will now be discussed. As briefly mentioned above, ex-situ conditioning generally occurs between polishing steps. That is, after a set of wafers has been polished and removed from the polishing pad, a separate conditioning device is introduced against polishing pad 126 to condition the pad. It should be noted, however, that apparatus 100 does not have to utilize both in-situ and ex-situ conditioning. One skilled in the art will appreciate that apparatus 100 may include either in-situ conditioning or ex-situ conditioning, or apparatus 100 may include both.

Figure 7:
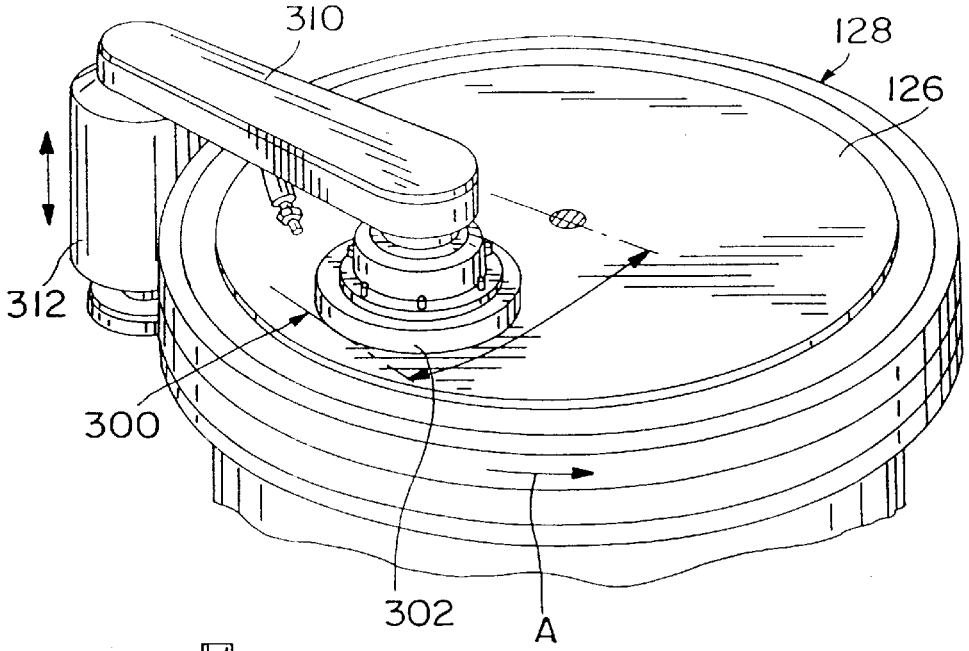
FIG. 7 is a perspective view of the polishing surface of the polishing machine shown in FIG. 1 with an ex situ polishing pad conditioning apparatus in operative engagement with the polishing surface.
Figure 8:
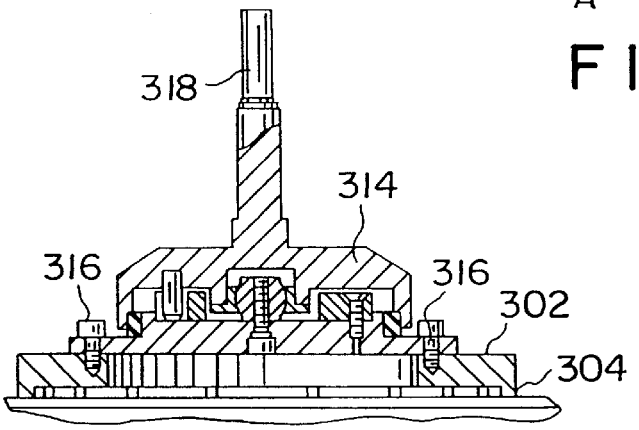
FIG. 8 is a side cross-sectional view of the ex-situ polishing pad conditioning ring holder shown in FIG. 7.
Figure 9:
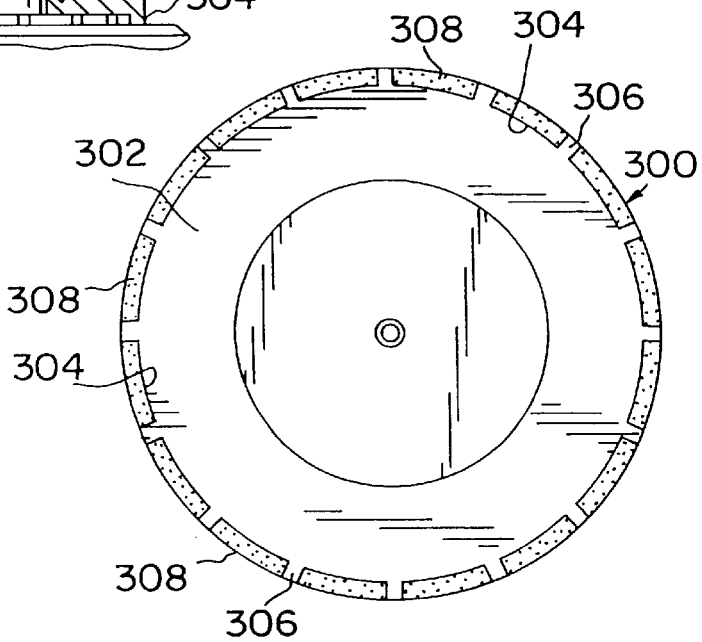
FIG. 9 is atop view of an ex-situ polishing pad conditioning ring.

Referring now to FIGS. 7–9, an ex-situ conditioning device 300 preferably comprises a circular conditioning ring carrier element 302 made of a rigid material, such as metal. In accordance with this aspect of the present invention, ring carrier element 302 preferably has a downwardly extending flange 304 which, during operation, will contact and condition the polishing pad. In accordance with a further aspect of this embodiment of the invention, flange 304 may be interrupted by a plurality of cut outs 306 which permits sworf and fluids to escape from the interior of conditioning device 300 during operation.

As with the in-situ conditioning ring and as illustrated in FIG. 9, cutting elements 308 may be secured to the bottom surface of flange 304. Similarly, cutting elements 308 may comprise a variety of materials, such as, for example, diamond particles, polycrystalline chips/slivers, cubic boron nitrite particles, silicon carbide particles, and the like. As discussed in detail below, cutting elements 308 may be attached to the bottom portion of flange 304 by a unique braze bonding process. Finally, a composition comprised of either a titanium nitride or a thin film diamond is used to coat the cutting elements 308 (See FIGS. 10 and 11) in order to strengthen the bond between the cutting elements 308 and the conditioning element and to further strengthen the cutting elements 308 themselves so that fractures and losses of the cutting elements 308, as well as plating wear, are reduced. The coating composition is also discussed in further detail below, along with the braze bonding process of the cutting elements 308.

In accordance with this preferred embodiment of the invention, conditioning device 300 preferably is attached to an operating arm 310 which is configured to raise and lower conditioning device 300 into and out of engagement with polishing pad 126. The vertical movement of operating arm 310 is controlled by a pressure cylinder 312. In addition, operating arm 310 may also be adapted for moving conditioning device 300 back and forth across the top of pad 126, thus insuring that the entire top surface of the pad is conditioned equally. Various means may be employed to connect conditioning element 300 to operating arm 310. For example, as illustrated in FIG. 8, ring 302 may be secured to a bearing housing 314 by shoulder bolts 316. In accordance with this configuration, a shaft 318 may be configured to engage a chuck in the head of operating arm 310, thus holding the housing and ring assembly in operative engagement with the arm.

During processing, when it is desired to condition polishing pad 126, arm 310 is activated to bring conditioning device 300, and more particularly cutting elements 308, into contact with the top surface of polishing pad 126. In addition, lap wheel 128 rotates (e.g., counter-clockwise) and, at the same time, operating arm 310 oscillates causing conditioning element 300 to traverse back and forth across the surface of polishing pad 126. The downward pressure that the conditioning device exerts on the polishing pad surface and the length of time that the conditioning element is in contact with the pad may vary as necessary to achieve the desired conditioning results.

Figure 10:
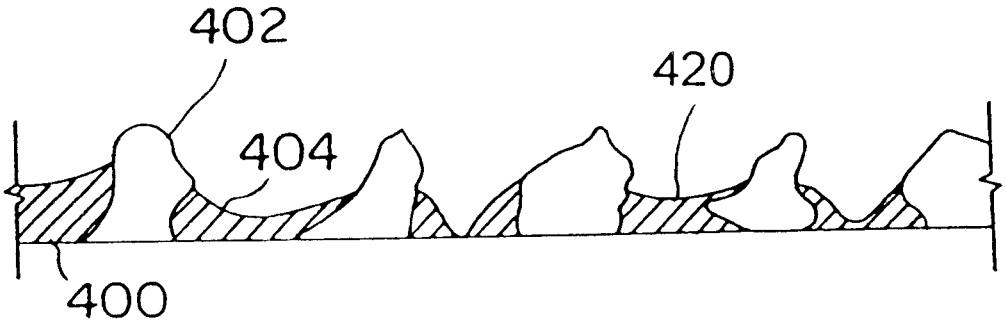
FIG. 10 is a cross-sectional view of cutting elements which have been braze bonded to a conditioning ring and coated with a composition in accordance with the present invention.
Figure 11:
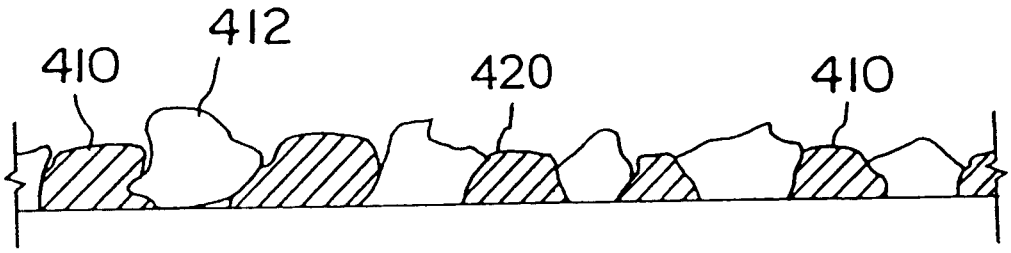
FIG. 11 is a cross-sectional view of cutting elements which have been electroplated to a conditioning ring and coated with a composition in accordance with the present invention.

Referring now to FIGS. 10 and 11, the subject method of attaching the cutting elements to the conditioning rings will now be discussed. In accordance with a preferred embodiment of the present invention, cutting elements 402 may be attached to a carrier ring 400 by a direct brazing technique which creates a very strong, reliable bond between the cutting elements and the ring surface. The brazing method of the present invention utilizes readily available, very hard and durable brazing alloys to create the secure bond. The brazing alloys utilized generally comprise nickel-chromium or cobalt-nickel-chromium combinations. It has been found that this family of brazing alloys creates superior chemical/mechanical bonds because the alloys tend to cling to the cutting element surfaces rather than flowing away from them during the treatment process. Thus, greater surface contact between the cutting elements and the alloy are achieved.

The process of bonding cutting elements 402 to the conditioning ring surface 400 will now be discussed. In accordance with one aspect of the present invention, cutting elements 402 and braze alloy particles 404 are suitably placed on the metal ring surface in a predetermined fashion. To hold the cutting elements and braze alloy particles in place, a temporary binding agent may be used, such as, for example, a resinous compound dissolved in a suitable organic solvent, or the like. Upon proper distribution of the cutting elements and alloy particles, the ring assembly is then placed in a furnace having a reducing atmosphere or vacuum and heated until the braze flows and wets the cutting elements and metal ring surface. Finally, the braze is cooled, securely bonding the cutting elements to the ring surface.

The braze bonded cutting elements are then coated with a composition in order to reduce the fracturing and loss of the cutting elements thereby reducing the likelihood that portions of the cutting elements will become embedded in the polishing pad resulting in the scratching of the wafers. Subsequent to coating, the braze bonded cutting elements may be subjected to a heating process in order to securely bond the coating. The heating process may comprise placement of the coated ring assembly into a furnace having a reducing atmosphere or vacuum and then heating the assembly. The coated assembly is then cooled to securely bond the coating. Fewer scratched wafers result in less scrap and increased efficiency. Further, coating of the cutting elements reduces plating wear thereby increasing the lifetime of the conditioning elements or rings used in the conditioning process. Preferable compositions for the coating are as follows:

1) a titanium nitride based coating which comprises both titanium nitride and zirconium nitride (an example of such a product is SUPERNEXUS produced by GSEM, Inc. in Beaverton, Oreg.); or
2) a thin film diamond deposition which comprises man-made diamond particles that are produced by heating carbon and a metal catalyst in an electric furnace at about 3000 degrees F. under high pressure.

In accordance with another aspect of the present invention, the brazing process may be performed in two-steps rather than one as discussed above. In the two-step process, the brazing alloy is first applied to the ring surface in a manner similar to that described above, however, the cutting elements are not present. After the braze alloy is fused to the ring surface, the cutting elements are then attached to the layer of braze alloy on the ring surface by using a temporary binder. After the cutting elements are properly positioned, the ring assembly again is placed in the furnace until the braze remelts and surrounds the cutting elements. This two-step process generally achieves the same bonding strength as the one-step method, but the two-step process allows for greater control of surface uniformity of the cutting elements on the ring surface. A more detailed discussion of a brazing process useful in the context of the present invention is discussed in Lowder et. al, U.S. Pat. Nos. 3,894,673 and 4,018,576 issued on Jul. 15, 1975 and Apr. 19, 1977 respectively, both of which are incorporated herein by reference. The braze bonded cutting elements are then coated with a coating composition as previously described above.

In accordance with a further aspect of the present invention, the subject process of braze bonding the cutting elements to the carrier ring surface exhibits superior performance compared to the conventional electroplating bond currently known in the art. Improvements such as the ability to control the amount of plating, the ability to control the amount and placement of the cutting elements on the ring, better adhesion of the cutting elements to the ring surface, the ability to have predictable and repeatable conditioning rings, and better pad management due to the control of the cutting elements, plating, and spacing of the elements are achieved. All such improvements are related to the fact that the invention provides for better bonding of the cutting elements to the conditioning ring surface with less bond metal than has been previously possible. In this regard, the brazing method provides optimal support for each and every cutting element on the ring because during the fusing process, the braze alloy encompasses the side and bottom surfaces of each element, thus forming the solid bond. This aspect of the invention is shown in FIG. 10 which depicts a cross-section of cutting elements 402 brazed to the surface of conditioning ring 400. The bond surface 404 is characterized as "concave", i.e., the alloy metal bond depth is at a minimum at a point intermediate adjacent elements. A cross-section of cutting elements electroplated to the conditioning ring in accordance with prior art techniques is shown in FIG. 11. As distinguished from FIG. 10, the surface contour of the bonding metal 410 is inherently convex in the electroplated device, thus providing minimal support for cutting elements 412 for a given depth of bond metal. Therefore, with the electroplating process, the bond is weaker even though more bond metal is used. In fact, as much as 50% to 100% of the cutting elements may be covered by the bond metal with the electroplating process. However, with the braze process, the cutting elements can be bonded with as little as 25% to 40%,of the cutting element being covered with bond, therefore allowing greater sworf clearance, faster cutting and reduced heat build up. FIGS. 10 and 11 also show a thin composition coating 420, which has been previously described in detail, deposited over the cutting elements. It should be noted that regardless of whether the cutting elements are braze bonded or electroplated, the composition coating 420 provides for the same types of advantages and improvements in the conditioning process over the prior art, namely reducing or eliminating fracturing and loss of cutting elements and reducing plating wear.

In accordance with a further aspect of the present invention, cutting elements having an aspect ratio in the range of 0.5:1.0 to 1.5:1.0, and most preferably about 1.0:1.0 are suitably employed; that is, in a particularly preferred implementation of the present invention, the height of the cutting elements is approximately equal to the width of the cutting elements. In this way, the effectiveness of the subject bonding technique, as well as the effectiveness of the various cutting elements in the pad dressing operation are substantially independent of the orientation of the cutting elements.

It should be noted, that this braze bonding process can be used to attach cutting elements exhibiting different material properties. For example, as discussed above, cutting elements may comprise diamond particles, polycrystalline chips/slivers, cubic boron nitrite particles, silicon carbide particles, and the like. However, for conditioning semiconductor wafer polishing pads, diamond and cubic boron nitrite particles are preferred. Further, with respect to the composition used to coat the braze bonded cutting elements, the preferred compositions include a titanium nitride based coating or a thin film diamond deposition where the diamond particles contained in the deposition are manmade.

It will be understood that the foregoing description is of preferred exemplary embodiments of the invention and that the invention is not limited to the specific forms shown or described herein. Various modifications may be made in the design, arrangement, and type of elements disclosed herein, as well as the steps of making and using the invention without departing from the scope of the invention as expressed in the appended claims.

What is claimed is:

1. An apparatus for conditioning a polishing pad of a chemical mechanical polishing machine used to polish precise surfaces on semiconductor wafers, the apparatus comprising:

means for conditioning the polishing pad by contact with the pad, wherein said conditioning means is configured with cutting elements secured to a surface of said conditioning means wherein said secured cutting elements are coated with a composition that reduces fracturing of the cutting elements; and means for engaging said conditioning means with the polishing pad to permit conditioning of the pad by removal of material from a polishing surface of the pad.

2. The apparatus recited in claim 1, wherein said composition comprises at least one of titanium nitride containing composition and a thin film diamond deposition.

3. The apparatus recited in claim 2, wherein said composition comprises:

a titanium nitride component; and a zirconium nitride component.

4. The apparatus recited in claim 1, wherein said cutting elements are braze bonded to the bottom surface of the conditioning means and said composition comprises at least one of a titanium nitride containing composition and a thin film diamond deposition deposited over an entire surface of said brazed bonded cutting elements.

5. The apparatus recited in claim 1, wherein said means for engaging said conditioning means comprises an operating arm adapted for moving said conditioning means into, and out of, operative engagement with the top surface of the pad, and for oscillating and rotating said conditioning means radially over the top surface of the pad.

6. The apparatus recited in claim 1, wherein said conditioning means comprises a conditioning ring, and where said cutting elements are disposed on a bottom surface of said conditioning ring.

7. The apparatus recited in claim 6, wherein said cutting elements are disposed on a flange which extends about the periphery of said conditioning ring and wherein said flange includes cutout portions to permit materials to escape from the interior of said conditioning ring.

8. The apparatus recited in claim 7, wherein said cutting elements are substantially uniformly distributed on said flange.

9. The apparatus recited in claim 7, wherein said cutting elements are bonded to said flange with a brazed metal alloy.

10. The apparatus recited in claim 9, wherein said brazed metal alloy covers about 25% to 40% of said cutting elements.

11. The apparatus recited in claim 1, wherein said cutting elements comprise diamond particles.

12. An apparatus for conditioning a polishing pad of a chemical mechanical polishing machine while precision surfaces on semiconductor wafers are being polished on the pad, said apparatus being mountable to a movable carrier element for carrying the semiconductor wafers to be polished into contact with the polishing pad, said apparatus comprising means for conditioning the polishing pad by contact with the pad, wherein said conditioning means comprises cutting elements secured to a bottom surface of said conditioning means and a composition comprising at least one of a titanium nitride containing composition and a thin film diamond deposition covering said cutting elements.

13. The apparatus recited in claim 12, wherein said conditioning means is a ring configured to mount around the outer perimeter of the workpiece carrier element, and wherein said cutting elements are disposed on a bottom surface of said ring.

14. The apparatus recited in claim 13, wherein said cutting elements are disposed on a flange which extends about the periphery of the ring, and wherein said flange includes cutout portions to permit materials to escape from the interior of the ring.

15. The apparatus recited in claim 14, wherein said cutting elements are substantially uniformly distributed on said flange.

16. The apparatus recited in claim 14, wherein said cutting elements are bonded to said flange with a brazed metal alloy.

17. The apparatus recited in claim 16, wherein said brazed metal alloy covers about 25% to 40% of said cutting elements.

18. The apparatus recited in claim 12, wherein said cutting elements comprise diamond particles.

19. An apparatus for conditioning a polishing pad of a chemical mechanical polishing machine used to polish precise surfaces on semiconductor wafers, comprising:

a conditioning apparatus;

a plurality of cutting elements secured to a surface of said conditioning apparatus; and a composition comprising at least one of a titanium nitride containing composition and a thin film diamond deposition covering said plurality of secured cutting elements.

20. An apparatus for conditioning a polishing pad of a chemical mechanical polishing machine used for polishing precision surfaces of semiconductor wafers, the apparatus comprising:

a conditioning device for conditioning the polishing pad by contact with the pad;

a plurality of cutting elements braze bonded to a surface of said conditioning device; and means for engaging said conditioning device with the polishing pad for conditioning a polishing surface of the pad by removing material from the surface of the pad.

21. The apparatus of claim 20 wherein said plurality of cutting elements comprise at least one of a plurality of diamond particles, a plurality of polycrystalline chips, a plurality of polycrystalline slivers, a plurality of cubic boron nitrite particles, and a plurality of silicon carbide particles.

22. The apparatus of claim 20 wherein said plurality of cutting elements are substantially uniformly distributed over said conditioning device.

23. The apparatus of claim 20 wherein said cutting elements are bonded to said conditioning device with a braze metal alloy, said brazed metal alloy only covering about 25% to about 40% of said cutting elements.

24. The apparatus of claim 20 wherein said cutting elements are permanently brazed to said conditioning device.

25. The apparatus of claim 20 wherein said cutting elements have a width to height ratio within a range of about 0.5:1.0 to 1.5: 1.0.

26. The apparatus of claim 20 wherein said cutting elements are approximately equal in width and height.

27. The apparatus of claim 20 wherein said conditioning device comprises a ring shape.

* * * * *